US005664780A

United States Patent [19]

Bricker

[11] Patent Number: 5,664,780

[45] Date of Patent: Sep. 9, 1997

[54] BASEBALL PLAYER FIELD POSITION AND BATTING ORDER TRACKING APPARATUS

[76] Inventor: Anthony Bricker, 9976 Justamere La., Elk Grove, Calif. 95624

[21] Appl. No.: 727,132

[22] Filed: Oct. 8, 1996

Related U.S. Application Data

[63] Continuation of Ser. No. 381,190, Jan. 31, 1995, abandoned.

[51] Int. Cl.[6] ..... A63B 71/06

[52] U.S. Cl. ..... 273/239; 116/222; 273/288

[58] Field of Search ..... 273/239, 240, 273/288, 289, 25, 26 R; 116/222, 223, 224, 225

[56] References Cited

U.S. PATENT DOCUMENTS

| | | | |
|---|---|---|---|
| 402,700 | 5/1889 | Van Zile | 116/222 |
| 1,042,142 | 10/1912 | Pohlig | 116/222 |
| 2,145,664 | 1/1939 | Ristow | 116/120 |
| 2,355,905 | 8/1944 | Buxbaum | 116/222 |
| 2,918,730 | 12/1959 | Schrade | 116/222 X |
| 3,895,804 | 7/1975 | Lee | 273/239 X |
| 4,005,866 | 2/1977 | Marcil | 273/239 |
| 4,060,246 | 11/1977 | Ward | 273/239 X |

*Primary Examiner*—William H. Grieb
*Attorney, Agent, or Firm*—James M. Ritchey

[57] ABSTRACT

A baseball field position and batting lineup apparatus for tracking each player on a single team during a baseball game or practice. Included is a display board having an image of a baseball field and both a batting lineup region and a dugout region imaged on the display board. Two sets of tokens, one set for tracking current field positions on the baseball field image or lack of assigned field position on the dugout region and the second set for noting the current batting order of the players on the batting lineup region.

3 Claims, 3 Drawing Sheets

BASEBALL PLAYER FIELD POSITION AND BATTING ORDER TRACKING APPARATUS

CROSS-REFERENCE TO RELATED APPLICATIONS

This is a continuation of application Ser. No. 08/381,190 filed on Jan. 31, 1995 now abandoned.

BACKGROUND OF THE INVENTION

1. Field of the Invention

To be utilized in baseball games, a player field position and batter lineup tracking apparatus is disclosed. More specifically, for use by a single baseball team, a display panel with player tokens in which the display panel has regions for recording current player field positions and batting order.

2. Description of the Background Art

Ever since the creation of baseball various methods and devices have been finished to reflect in one way or another the status of the game as played between opposing teams. The existing devices are employed to note information for both teams during a baseball game. Such information includes player positions for the team on the field, batting order for the team at bat, statistics for the game, inning information, and the like.

Specifically, U.S. Pat. No. 402,700 presents a bulletin board and baseball indicator for tracking data on both teams during a game. Pins that are coded for each of the two teams are used in connection with a board to note the state of the game and which players are up to bat, on base, and the like. Player's names for both teams are written into slots indicating the batting order. Regions for statistical records such as hits, runs, errors, and the like are provided.

U.S. Pat. No. 2,355,905 relates a baseball game that follows the hitting and base running actions of two teams pitted against one another. Cutout player pieces with tabs are utilized to note the players in each team's dugout. These player pieces are moved onto the field and around the bases as the game progresses. Statistical data and inning data for the game is recorded in suitable locations of the playing board.

A baseball game board and associated components that is utilized with a chance device is disclosed in U.S. Pat. No. 1,042,142. Once again, game information is noted for each of two opposing teams on a board. The board has a field that permits the user to follow the base runners and fielders. Stick figures are employed to note player positions.

Presented in U.S. Pat. No. 2,145,664 is a baseball chart used to follow the action of both teams on radio reported baseball games. The actions of each player on both teams are presented on individualized cards that can include an image of the particular player as well as relevant statistical data for the game. Separate pit cards are used to follow who has batted and who is next to bat. Player pieces are moved from one before batting area on the pit card to another area after batting.

A child's behavior recording and incentive device is supplied via U.S. Pat. No. 2,918,730. The trials and tribulations of a child baseball player are recorded on the device. Prize certificates are included for superior achievement.

Games that include the use of game pieces that are releasable attached to the playing board are related in U.S. Pat. Nos. 3,895,804 and 4,005,866. Magnets, VELCRO, and like releasable attachment systems are utilized with these games.

U.S. Pat. No. 4,060,246 illustrates a typical board game having various regions for recording game data.

For those on or interested in one team's positional data, it is important to be aware of the current field positions and batting order for each player. The subject apparatus is an improvement over the prior art since it clearly presents in an easily and rapidly changed and perceived manner field position information and batting order listings for one team only. Changes in the position, batting order, or those designated to be on the bench for players is rapidly accounted for and plainly presented for all players and coaches to see. Prior art devices presented too much data for two teams in a ways that did not readily lend themselves to rapid cognition and reordering.

The foregoing patents reflect the state of the art of which the applicant is aware and are tendered with the view toward discharging applicant's acknowledged duty of candor in disclosing information which may be pertinent in the examination of this application. It is respectfully submitted, however, that none of these patents teach or render obvious, singly or when considered in combination, applicant's claimed invention.

SUMMARY OF THE INVENTION

An object of the present invention is to provide a means for tracking quickly and clearly both the field positions and batting order for the members of one baseball team.

Another object of the present invention is to disclose a display board utilized to follow field positions, batting order, and whether players are not currently playing a field position.

A further object of the present invention is to create a display means for a baseball team that shows which player has which current field position, the current batting order, and players not currently assigned a field position in which the means for tracking this data is clearly seen and easily rearranged when desired or required.

Still another object of the present invention is to supply a display apparatus for a baseball team that relates current field positions and batting order for only that team and is adapted for mounting in a readily perceivable location for players to see.

Yet a further object of the present invention is to present an inexpensive and efficient field position and batting order recording apparatus that utilizes releasably secured tokens with player indicia on a clearly visible upper token surface on a display board to track the current data.

Disclosed is a baseball field position and batting lineup apparatus for tracking each player on a single team during a baseball game. Comprising the subject apparatus is a display board having first pictorial means for displaying a current position for each player on a baseball field, second pictorial means for displaying a current place for each player in a batting lineup, and preferably third pictorial means for displaying each player not having a current position on the field.

More specifically, a baseball field position and batting lineup apparatus for tracking each player on a single team during a baseball game comprises a display board that is usually flat and rectangular. On the display board is an image of a baseball field. Additionally, a batting lineup region is formed on the display board as is a dugout region. Supplied is a first set of releasable tokens. Each token within the first set of releasable tokens is comprised of a first surface having means for releasably attaching the token to the display board and a second surface having means for removably recording a first identification indicia for a particular player. The placing of the first set of tokens or a portion of the first set of tokens on the baseball field image indicates the current position for each player on the baseball field and the placing of any of the first set of tokens on the dugout region indicates players not having a current field position. Also, provided is a second set of releasable tokens, wherein each token within the second set of releasable tokens comprises a first surface having means for releasably attaching the token to the display board and a second surface having means for removably recording a second identification indicia for a particular player. The sequential placing of the second set of tokens or a portion of the second set of tokens on the batting lineup region indicates the batting order.

Other objects, advantages, and novel features of the present invention will become apparent from the detailed description that follows, when considered in conjunction with the associated drawings.

DESCRIPTION OF THE PREFERRED EMBODIMENT

Figure 1:
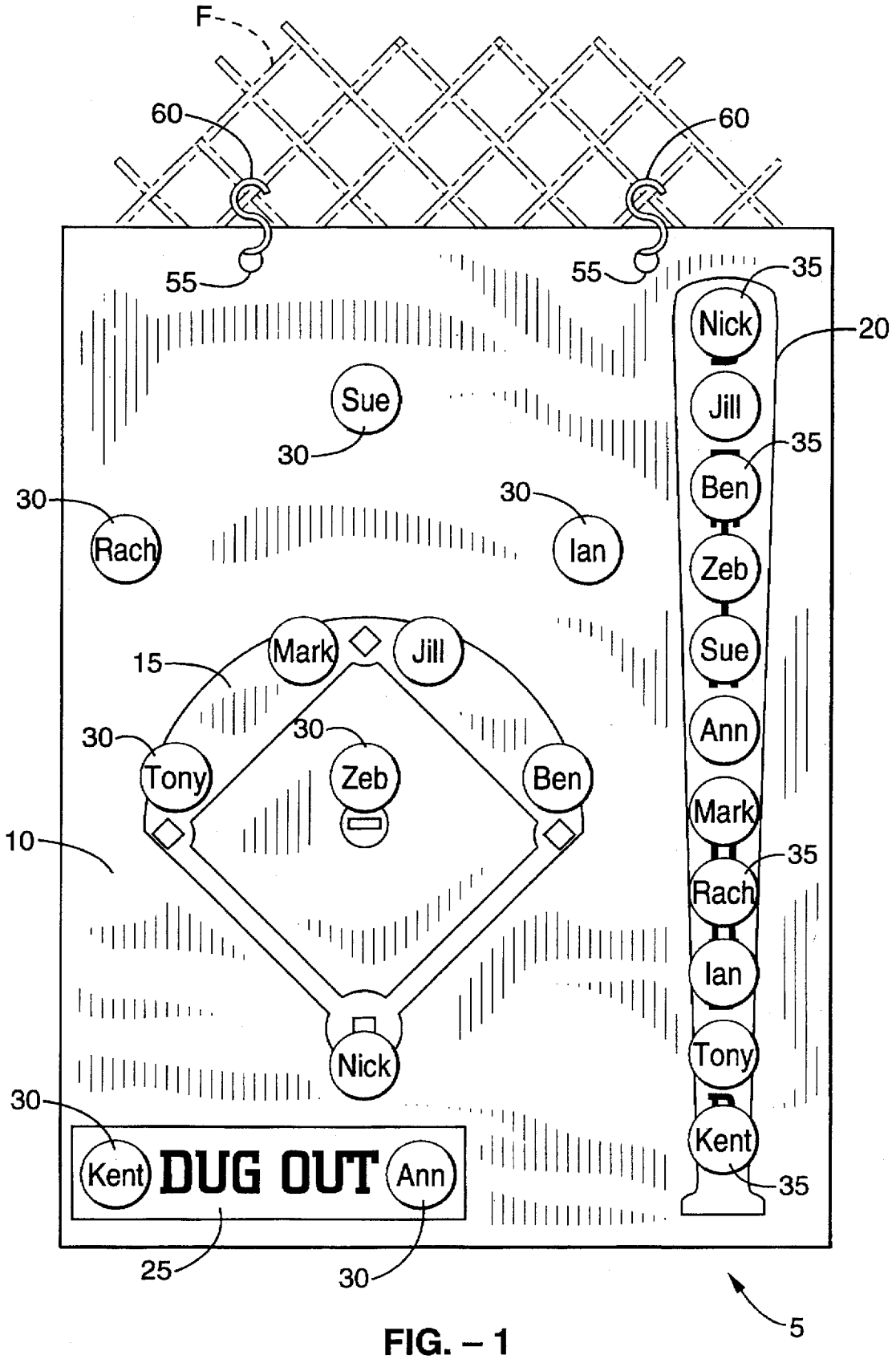
FIG. 1 is a front view of the subject apparatus.
Figure 2:
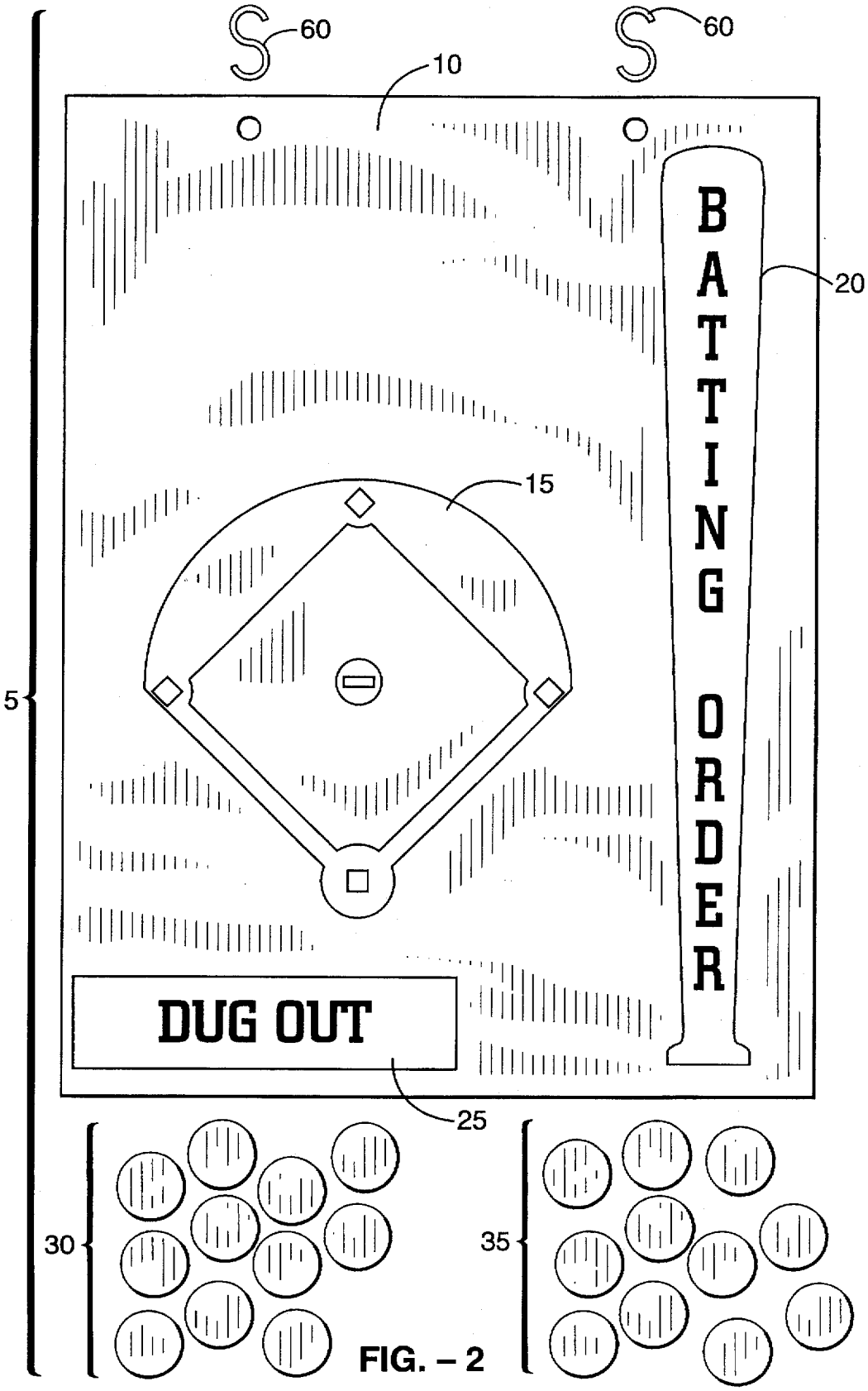
FIG. 2 is an exploded view of the subject apparatus showing the components.
Figure 3:
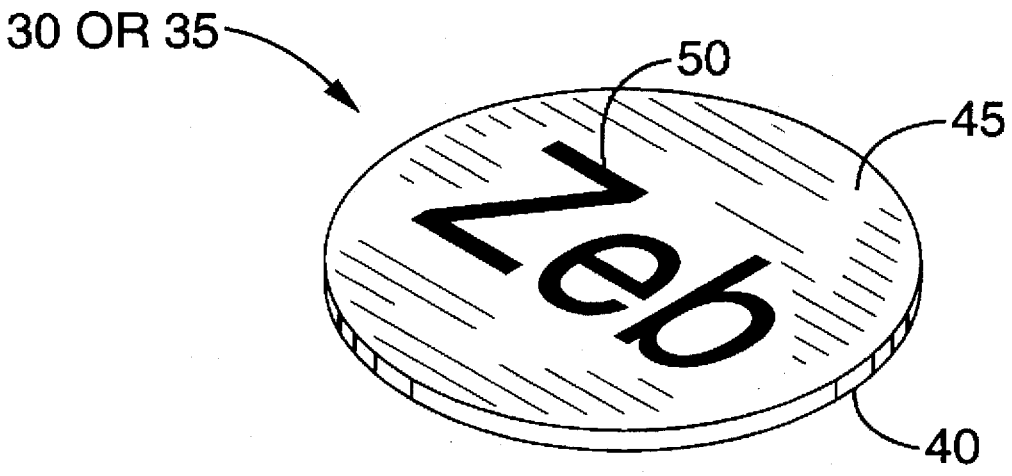
FIG. 3 is perspective view of a token utilized in the subject apparatus.

Referring now to FIGS. 1–3, there is shown a preferred embodiment of an information tracking apparatus that is used by a single baseball team during a game or practices to follow current field positions, current batting order, and which players are not currently assigned a field position. The subject device is employed by coaches and players on a baseball team to rapidly note the state of player pool in terms of where the players are located on the field, the exact order for batting, and who might be sitting on the bench when the team is on the field.

Various levels and styles of baseball exist (including hardball, T-ball, softball, and the like) and the coaches, players, and even spectators involved in these baseball endeavors would find the subject invention extremely useful. With each level and style of baseball the exact rules of the game may slightly vary. Baseball teams are usually grouped by specific requirements (age, sex, playing competence, and the like) into leagues that, at least in part, decree the rules by which the member teams play. Many baseball leagues for children permit more than the traditional nine players to bat, yet restrict the field positions to the standard nine players, thereby having some children bat but sit on the bench during field play. Some leagues sanction more than nine players of one team on the field at the same time. Other leagues retain the traditional nine players on the field and the same nine players at bat, while others still permit a designated hitter to hit for the pitcher. The subject invention permits all of these variations and others to be quickly and easily noted on a clearly exhibited on a display board. In particular, since the subject invention presents critical batting and field position information in a clear and rapid fashion, baseball games and practices played by children (often having minimal playing experience and short attention spans) are targeted by the subject invention.

As seen in FIGS. 1 and 2, comprising the subject invention is a display board 10. The display board is generally rectangular in shape, however, any shape is suitable and within the purview of this disclosure. The display board 10 has an upper surface upon which relevant game information is recorded. An pictorial representation of a typical baseball field or baseball field image 15 is placed on the upper surface of the display board 10 (i.e., the image 15 shows a pictorial approximation of an actual baseball field used to play a game). As seen in more detail below, the baseball field image 15 is utilized in the subject invention for displaying current field positions for each player on the field. The baseball field image 15 (as well as the batting lineup region and dugout region noted below) is applied by any of a number of standard procedures, including painting, laminating, silk screening, and the like. The image 15 includes the standard components of a baseball field including a baseball diamond, pitcher's mound, and outfield locations. For easy viewing and in keeping with the custom of the game being played on a dirt and grass area, the baseball field image 15 is usually colored traditional shades of dirt brown and grass green, but other colors or lack of colors are acceptable.

An area of the display board shows a designated batting lineup region 20, usually pictorially (i.e., a picture that reflects some property associated with batting, like a representation or figure of a baseball bat), that is utilized in the subject apparatus to track and display the current batting order of the team's players. The batting lineup region 20 is presented in a readily seen form so that players and coaches can quickly focus on the area they know will list, sequentially, the current batting order. To further clarify that the pictorial representation or bat 20 represents the area that presents the batting lineup or order, the words "BATTING ORDER" or "BATTING LINEUP" or the equivalent are usually included and printed on the batting lineup region or bat 20. The batting lineup baseball bat 20 is usually vertically oriented and the player listed at the top of the bat is first up to the plate.

An area of the display board shows a dugout region 25, usually pictorially (i.e., a picture that reflects some property associated with "sitting on the bench", like a representation or figure of a generally rectangular dugout or area where actual players sit while waiting to participate in the game or practice). As discussed below, the dugout region 25 is utilized in a pictorial means for displaying each player not having a current position on the field. Players not currently in the lineup may also be displayed here. Likewise, as above with the batting lineup region, to further clarify that the pictorial representation of the dugout represents the area the notes the players not having current field assignments, the word "DUGOUT" or "BENCH" or the equivalent are usually included and printed on the dugout region.

The subject device is utilized to track, for a single team, who is at what field position, who is up, and who is not currently assigned a field position. In tracking these three informational items, the subject invention employs two sets of tokens. A variable number of first tokens 30 are within a first set of tokens which are used in conjunction with the baseball field image 15 and dugout region 25 to indicate those players with a currently assigned field position and those players with no currently assigned field position, respectively. A variable number of second tokens 35 (but, generally the same as the number of first tokens 30) are within a second set of tokens which are used in connection with the batting lineup region 20 to indicate the order in which the players come to bat. If a player is not currently in the lineup to bat their token 35 may be located in the dugout 25 region, removed from the board 10, or placed in another region (see below).

FIG. 3 illustrates the details of a typical first 30 or second 35 token. The tokens 30 and 35 have a lower or first surface 40 and an upper or second surface 45. The upper surface 45 is adapted to permit a user to record erasably a player's indicia 50. Generally, the tokens 30 and 35 have an upper surface 45 that can be directly written upon or is fabricated from material or substances suitable for presenting the indicia 50, such as a paint, natural or synthetic polymers like vinyl or other plastic or similar product that allows a user to write or note the desired indicia 50 on the token 30 or 35. The upper surface 45 material is selected to permit the user to erase, change, or remove the indicia 50 when desired. The indicia 50 is a name, number, code, color, and the like that indicates a particular player (in FIGS. 1–3 each indicia 50 is the player's name). Once again, each player on the team has two tokens 30 and 35 that clearly indicate, via the indicia 50, that they are that player's tokens 30 and 35. One token 30 is utilized to note the player's field position or lack thereof and the other token 35 is employed to follow the player's batting order position.

The display board 10 and tokens 3d and 35 are configured and designed to interact releasably with one another. When any token 30 and 35 is placed on the display board 10 it is releasably anchored to the display board 10 with sufficient force to stay affixed until the user removes or relocates the token 30 and 35. Various means exist to produce the required token 30 and 35 to display board 10 releasable interaction. Usually, the display board 10 is fabricated from metallic materials suitable for releasably binding magnet containing items such as the tokens 30 and 35. Thus, preferably, the releasably interaction between the tokens 30 and 35 and the display board 10 is a magnetic attraction of suitable force to accomplish binding the tokens 30 and 35 in a fixed position until the user removes or relocates them. Even though the preferred means of display board 10 to token 30 and 35 interaction is by magnetism, other attractive means such as VELCRO type loop-to-hook interactions, electrostatic interactions, frictional interactions, snap or hook mechanisms, tab and slot interactions, and equivalent processes are within the realm of this disclosure.

In using the subject invention it is often desirable to place the apparatus in a plainly visible location for the coaches and players to see. A mounting means is incorporated into the subject apparatus 5 for securing the display board 10 to a support such as a fence F or backstop. One preferred mounting means is to fabricate the display board 10 with one or more, preferably two, apertures 55 into which S-hooks 60 are fitted. The end of the S-hook that is fitted within the aperture 55 is pinched closed and the other end of the S-hook is left open for removably fitting over fence F wire, a fence edge, and the like.

Optionally, the display board 10 may include an "out of game" or "not currently active" region for placing tokens 30, or 35 of players that are on the team and present, but not currently in the game (having neither a field position nor a batting order position). Players not currently in the game may have once been in the game but were removed for a pinch hitter, pinch runner, injury, and like reasons or they may not currently have entered the game. Some users of the subject invention may select to simply use the dugout 25 region for placing tokens 30 and 35 for any player not actively in the game or practice.

Instructional means that clearly indicate how a user is to operate the subject device is optionally included. Described in the instruction means such as a manual or instruction sheet or sheets is a typical example of how to utilize the subject invention. For illustrative purposes only and not by way of limitation, the following typical method of use by a team coach is related. A user such as a coach positions in a prominent location the subject display board 10. The user then places the first set of tokens 30 or a portion of the first set of tokens 30 on the baseball field image 15, thereby indicating the current position for each player on the baseball field. Should any player not have a current field position, the user affixes these tokens 30 on the dugout region 25, thereby indicating players not having a current field position. Additionally, the user positions the second set of tokens 35 or a portion of said second set of tokens 35 on the batting lineup region in a sequential order indicating the batting order. Extra second tokens 35 (those players not currently in the batting lineup) are placed in the dugout region 25 or stored in any desired location by the user.

The invention has now been explained with reference to specific embodiments. Other embodiments will be suggested to those of ordinary skill in the appropriate art upon review of the present specification.

Although the foregoing invention has been described in some detail by way of illustration and example for purposes of clarity of understanding, it will be obvious that certain changes and modifications may be practiced within the scope of the appended claims.

What is claimed is:

1. A baseball field position and batting lineup apparatus for use by players and coaches in tracking each player on a single team during a baseball game comprising:

a) a display board;

b) first pictorial means for displaying a current field position for each player on the single team, wherein said first pictorial displaying means comprises:

an image of a baseball field placed on said display board and a first set of releasable tokens comprising one token for each player having a current field position and at least one token for a player not currently having a field position on the single team, whereby the placing of said token for each player having a current field position on said baseball field image indicates said current position for each player on the baseball field for the single team;

c) second pictorial means for displaying a current place for each player in a batting lineup, wherein said second pictorial lineup displaying means comprises:

a pictorially designated batting lineup region on said display board and a second set of releasable tokens, one for each of the players on the single team, whereby the placing of said second set of tokens or a portion of said second set of tokens on said batting lineup region indicates said batting order on the single team; and d) a dugout region on said display board for displaying each player on the single team not having a current position on the field, wherein said at least one token for a player not currently having a field position on the single team within said first set of tokens is placed in said dugout region.

2. A baseball field position and batting lineup apparatus for a single team according to claim 1, wherein said pictorially designated batting lineup region comprises a baseball bat shaped figure.

3. A baseball field position and batting lineup apparatus for a single team according to claim 2, wherein said baseball bat shaped figure is vertically oriented to indicate a ranked order in batting from a top of said baseball bat being first to bat to a handle of said baseball bat being last to bat.

* * * * *